US005752985A

United States Patent [19]

Nagafune et al.

[11] Patent Number: 5,752,985

[45] Date of Patent: May 19, 1998

[54] CLEAN ROOM HAVING AN AIR CONDITIONING SYSTEM

[75] Inventors: Hitoshi Nagafune; Takaaki Fukumoto; Hakushi Shibuya; Koji Ezaki, all of Tokyo, Japan

[73] Assignee: Mitsubishi Denki Kabushiki Kaisha, Tokyo, Japan

[21] Appl. No.: 833,429

[22] Filed: Apr. 7, 1997

[30] Foreign Application Priority Data

Sep. 24, 1996 [JP] Japan ..... 8-251768

[51] Int. Cl.[6] ..... B01L 1/04; B01D 50/00

[52] U.S. Cl. ..... 29/25.01; 454/187; 55/385.2

[58] Field of Search ..... 454/187; 29/25.01; 55/385.2

[56] References Cited

U.S. PATENT DOCUMENTS 4,694,736 9/1987 Yamagata et al. .

5,326,316 7/1994 Hashimoto et al. .

*Primary Examiner*—David Graybill

*Attorney, Agent, or Firm*—Leydig, Voit & Mayer, Ltd.

[57] ABSTRACT

Apparatus comprising an outside-air conditioner 2, an operation zone 4, a ceiling filter 8 such as an HEPA or ULPA filter, a fan filter unit 9 comprising a chemical filter and a draft fan arranged only on an overhead carrying apparatus 5 and storing apparatus 6 arranged in the operation zone 4 in a clean room 1 chemical mist causing chemical contamination is removed to the carrying apparatus 5 and storing apparatus 6.

15 Claims, 7 Drawing Sheets

CLEAN ROOM HAVING AN AIR CONDITIONING SYSTEM

BACKGROUND OF THE INVENTION

1. Field of the Invention

The present invention relates to a clean room for fabricating a semiconductor device or the like, in which local cleaning can be made.

2. Description of the Related Art

Semiconductor devices are conventionally fabricated in a clean room in which the temperature and humidity are controlled and from which foreign matter of a several-micron level is normally removed in order to prevent the product yield from decreasing due to contamination caused by the environment of the clean room.

FIG. 9 is an illustration showing a conventional clean room. In FIG. 9, a clean room 1 has an outside-air conditioner 2 for taking in outside air, controlling the temperature and humidity of the outside air, and then supplying the air to the clean room 1. The clean room 1 comprises a ceiling chamber 3 to which air is supplied from the outside-air conditioner 2, an operation zone 4 in which production apparatuses are arranged and operations are performed, and a utility zone 7 in which motive-power equipment and environment maintenance equipment are arranged. A ceiling filter 8 such as an HEPA (High Efficiency Particulate Air) filter or a ULPA (Ultra Low Penetration Air) filter for removing foreign matter such as dust of a several-micron level from the air in the ceiling chamber 3 is set between the ceiling chamber 3 and the operation zone 4, the operation zone 4 contacts the utility zone 7 through a grating 10 on the floor, and a circulation duct 11 for taking in the air from the operation zone 4 through the grating 10 and circulating the air to the ceiling chamber 3 from the utility zone 7 is set in the utility zone 7. Moreover, the clean room 1 is kept at a pressure higher than the outside-air pressure in order to prevent foreign matter from entering the clean room 1 from the outside air. However, because the air pressure in the clean room 1 lowers due to opening or closing of a door or exhaust gas from an apparatus, the air pressure is controlled so that it is kept at a constant value higher than the outside air pressure by constantly detecting the air pressure in the clean room 1 and changing the rotational speed of the draft fan of the outside-air conditioner 2.

Because a pattern is further fined and a film thickness is further decreased as the integration degree of a semiconductor device rises, chemical contamination due to chemical mist of a submicron level or gas containing organic and inorganic substances contained in the air in a clean room in which a semiconductor device is fabricated is considered as a problem. Particularly, in the fabrication process of a semiconductor device, chemical contamination of a semiconductor wafer when the wafer is carried between pieces of fabrication equipment or stored in a piece of fabrication equipment is a problem. This is because each piece of fabrication equipment improves the cleanliness in the piece of equipment by its own system by directly introducing an inactive gas such as nitrogen or having various built-in filters and fans. The chemical mist causing chemical contamination includes a sulfide-based gas and acid-based gas contained in drawn outside air, a gas evaporated from chemicals used for fabrication equipment in a clean room, and a gas evaporated from the concrete of the wall of the clean room or paint of the fabrication equipment. These gases gives the following bad influences to a semiconductor device.

1. They cause corrosion of a metal or the like used for a semiconductor device and lower the reliability of the semiconductor device. Particularly, in the case of aluminum wiring pattern, the wiring resistance is increased or wiring is disconnected to cause transistor characteristics to change or transistor functions to deteriorate.

2. In the case of film formation by CVD, a film is abnormally deposited due to contamination of the film surface and a pattern is easily abnormally formed.

3. A fluorine-based gas changes properties of the surface state, and sodium ions proliferate and oxidize an oxide film, cause an abnormal oxide film, and change transistor characteristics.

FIG. 10 shows a case of arranging chemical filters 33*a*, 33*b*, and 33*c* capable of removing chemical mist on the circulation system of the clean room 1. A chemical filter 33*a* is set under the grating 10, a chemical filter 33*b* set to the circulation duct 11 for circulating air from the utility zone 7 to the ceiling chamber 3, and a chemical filter 33*c* added to the ceiling filter 8. By setting at least any one of the chemical filters 33*a*, 33*b*, and 33*c* in the clean room 1, chemical mist is removed from the operation zone 4.

A conventional clean room is constituted as described above. In the fabrication process of a semiconductor device, chemical contamination of a semiconductor wafer when the wafer is carried between pieces of fabrication equipment or stored is particularly a problem. However, an HEPA filter or ULPA filter cannot remove chemical mist contained in air such as a gas generated from a chemical substance, or the system of arranging the chemical filters 33*a* to 33*c* capable of removing chemical mist in the air circulation system of the clean room 1 and passing the whole air in the clean room 1 through the chemical filters 33*a* to 33*c* to remove the chemical mist from the whole operation zone 4 of the clean room 1 has problems that the initial and running costs of an air conditioning system increase.

SUMMARY OF THE INVENTION

The present invention is made to solve the above problems and its object is to provide a clean room making it possible to prevent chemical contamination of a semiconductor wafer when the wafer is carried or stored in the semiconductor device fabrication process and moreover, locally perform air conditioning according to necessity.

A clean room of the present invention comprises an outside-air conditioner taking in outside air and controlling the temperature and humidity of the outside air and supplying first-cleanliness air controlled to a first dust-free level to the clean room so that the inside of the clean room is kept at a pressure higher than the outside-air pressure, a ceiling chamber to which the first-cleanliness air is supplied from the outside-air conditioner, a ceiling filter for cleaning the first-cleanliness air in the ceiling chamber up to second-cleanliness air at a second dust-free level, a fan filter unit set to the upstream side of the ceiling filter to remove a predetermined chemical substance from air up to a predetermined content level, an operation zone to which the air controlled to second cleanliness by the ceiling filter is supplied and in which the chemical-free air controlled to the third cleanliness at a second dust-free level by the fan filter unit is supplied to a predetermined region, a utility zone which is located under the grating floor in the operation zone and in which motive-power supply equipment and environment maintenance equipment are arranged, and an air circulation system for controlling the temperature of the air to be exhausted from the operation zone to the utility zone and circulating air from the utility zone to the ceiling chamber through a duct.

Or, a clean room of the present invention comprises an outside-air conditioner taking in outside air and controlling the temperature and humidity of the outside air and supplying first-cleanliness air controlled to a first dust-free level to the clean room so that the inside of the clean room is kept at a pressure higher than the outside-air pressure, a chemical-free generator taking in outside air and controlling the temperature and humidity of the outside air and generating the fourth-cleanliness chemical-free air which is controlled to a first dust-free level and from which a predetermined chemical substance is removed up to a predetermined content level, a ceiling chamber to which the first-cleanliness air is supplied by the outside-air conditioner, an air guiding cover which is set in a predetermined region in the ceiling chamber and to which the fourth-cleanliness chemical-free air is supplied from the chemical-free air generator, a first ceiling filter for cleaning first-cleanliness air in the ceiling chamber up to second-cleanliness air at a second dust-free level and a second ceiling filter for cleaning the fourth-cleanliness chemical-free air to the third-cleanliness air at the third dust-free level, an operation zone to which the air controlled to second cleanliness by the first ceiling filter is supplied and in which the chemical-free air supplied into the air guiding cover is cleaned up to the third-cleanliness chemical-free air by the second ceiling filter and supplied to a predetermined region, a utility zone which is located under the grating floor in the operation zone and in which motive-power supply equipment and environment maintenance equipment are arranged, and an air circulation system for controlling the temperature of the air to be exhausted from the operation zone to the utility zone and circulating air from the utility zone to the ceiling chamber through a duct.

Moreover, the chemical-free air generator is a chemical removing apparatus to which first-cleanliness air is supplied from an outside-air conditioner to remove a predetermined chemical substance from the first-cleanliness air up to a predetermined content level.

Furthermore, the first-cleanliness air is supplied to the utility zone from the outside-air conditioner.

Furthermore, the air pressure in a predetermined region in the operation zone is controlled so as to be kept higher than the air pressure in other region in the operation zone.

Furthermore, a predetermined region in the operation zone serves as a portion in which a carrying apparatus and a storing apparatus respectively having an opening through which the introduced the third-cleanliness chemical-free air is exhausted to the outside are set.

Furthermore, the carrying apparatus is an overhead-type carrying apparatus hung from the ceiling in the operation zone; provided with a holding portion for holding a carried object, a driving portion in which a drive and the like are arranged, a cover for separating the holding portion from the driving portion through a gap, and an exhaust duct provided for the driving portion; and constituted so as to exhaust the air supplied through the ceiling filter portion to the utility zone from the exhaust duct of the driving portion through the gap of the cover from the holding portion.

Furthermore, the storing apparatus is an apparatus having a semi-hermetic structure set on the grating in the operation zone; provided with a side board extended in the direction of the ceiling filter portion in order to efficiently obtain the air supplied through the ceiling filter portion and a shelf board having a plurality of small-diameter holes; and constituted so as to exhaust the air supplied through the ceiling filter portion under the grating through the holes of the shelf board.

Furthermore, a clean room comprising an outside-air conditioner taking in outside air and controlling the temperature and humidity of the outside air and supplying first-cleanliness air controlled to a first dust-free level to the clean room so that the inside of the clean room is kept at a pressure higher than the outside-air pressure, a chemical-free dry air generator taking in outside air, and generating the fifth-cleanliness chemical-free dry air which is controlled the temperature and humidity and controlled to a second dust-free level and obtained by removing a predetermined chemical substance and moisture from air up to predetermined content levels, an operation zone in which a carrying apparatus and a storing apparatus respectively having a hermetic structure to which chemical-free dry air is supplied from the chemical-free dry air generator are arranged, a utility zone which is located under the grating floor in the operation zone, in which motive-power supply equipment and environment maintenance equipment are arranged, and to which air is supplied from the operation zone and exhaust ports of the carrying apparatus and storing apparatus and moreover, air is supplied from the outside-air conditioner, an air circulation system for controlling the temperature of the air in the utility zone and circulating the air to a ceiling chamber through a duct, and a ceiling filter set in the ceiling chamber to clean introduced first-cleanliness air up to second-cleanliness air and supply the second-cleanliness air to the operation zone.

Furthermore, the carrying apparatus is provided with the carrying route having a hermetic structure, a supply portion of dry air supplied from the chemical-free dry air generator provided for the ceiling portion of the carrying route, a holding portion provided for the top in the carrying route to hold a carried object, a driving portion which is provided for the bottom in the carrying route and in which a drive is arranged, a cover for separating the holding portion from the driving portion with a gap, and an exhaust duct provided for the driving portion and constituted so that the dry air supplied to the ceiling portion of the carrying route through a pipe is exhausted from the exhaust duct of the driving portion to the utility zone through the gap of the cover.

Furthermore, the carrying route is provided with current plates having a plurality of small-diameter holes and formed in parallel at a predetermined interval in order to uniformly supply the dry air supplied to a ceiling portion into the carrying route.

Furthermore, the carrying apparatus is provided with a carried-object detector, an opening to which an openable shutter is set, and a visor portion formed so as to protrude from the wall of a carrying route onto the opening having a portion for supplying the dry air supplied from the chemical-free dry air generator.

Furthermore, the storing apparatus is provided with a reservoir having a hermetic structure, a portion for supplying the dry air supplied from the chemical-free dry air generator provided for the ceiling portion of the reservoir, a shelf board having a plurality of small-diameter holes, and an exhaust duct provided for the bottom of the reservoir and constituted so that the dry air supplied to the ceiling portion of the reservoir through a pipe is exhausted to the utility zone from the exhaust duct through the holes of the shelf board.

Furthermore, the predetermined content levels of predetermined chemical substances of the third-cleanliness chemical-free air and the fourth-cleanliness chemical free air are kept in a range between 1 ppt and 1 f.

Furthermore, the predetermined content level of a predetermined chemical substance of the fifth-cleanliness chemical-free dry air is kept in a range between 1 ppt and 1 f and that of moisture of the dry air is kept at 1 ppb or less.

Furthermore, air controlled to higher cleanliness is the air passing through a high-performance filter of a ceiling filter portion and a fan filter unit.

DESCRIPTION OF THE PREFERRED EMBODIMENTS

Embodiment 1

Figure 1:
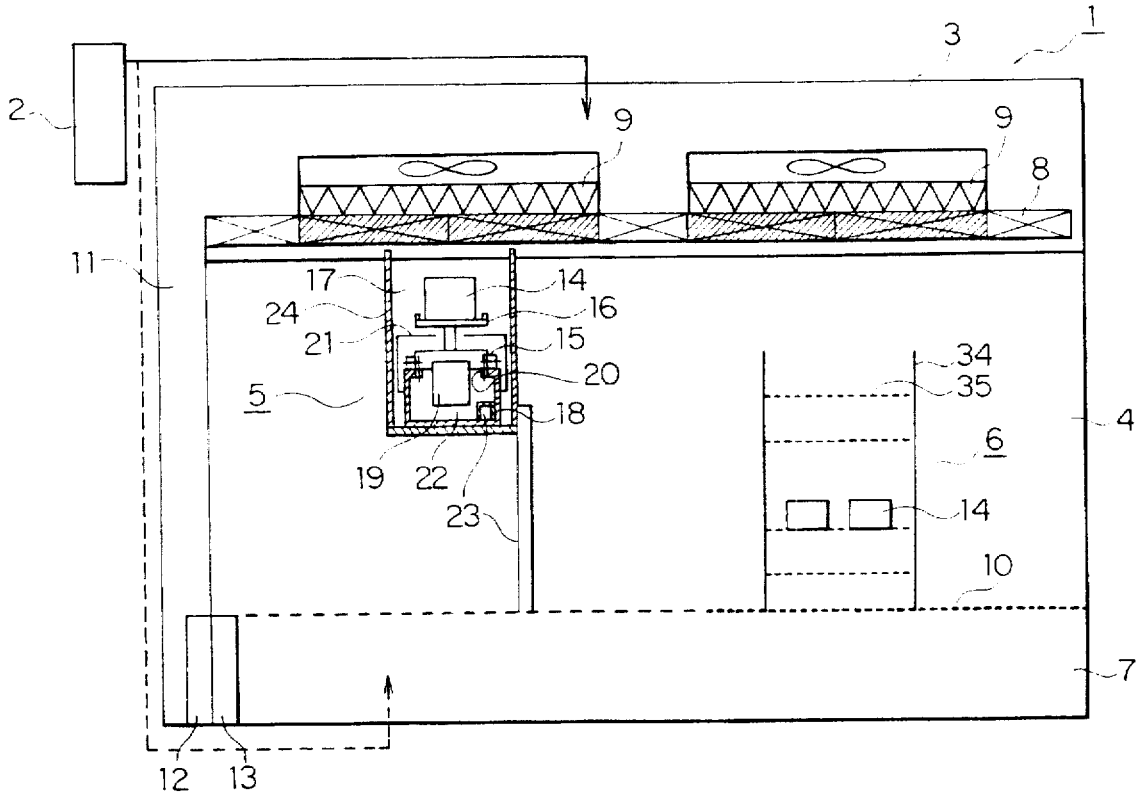
FIG. 1 is a schematic view showing the clean room of the embodiment 1 of the present invention.

A clean room of an embodiment of the present invention is described below by referring to the accompanying drawings. FIG. 1 is a schematic view showing a clean room of the present invention.

In FIG. 1, the clean room 1 has an outside-air conditioner 2 for taking in outside air to control the temperature and humidity of the outside air and thereafter supplying the air (first-cleanliness air controlled to a first dust-free level) to the clean room 1. The clean room 1 comprises a ceiling chamber 3 to which air is supplied from the outside-air conditioner 2, an operation zone 4 in which fabrication equipment, overhead-type carrying apparatus 5, and storing apparatus 6 are arranged and operations are performed, and a utility zone 7 in which motive-power equipment and environment maintenance equipment are arranged. A ceiling filter 8 such as an HEPA filter or a ULPA filter for removing foreign matter such as dust of a several-micron level from the air in the ceiling chamber 3 is set between the ceiling chamber 3 and the operation zone 4. A ceiling filter 8 removes dust of a several-micron level from the air in the ceiling chamber 3 and supplies the air to the operation zone 4. A fan filter unit 9 comprising a chemical filter and a draft fan is added in the ceiling filter 8 only to the top of the portion where the carrying apparatus 5 and storing apparatus 6 are arranged. The operation zone 4 contacts the utility zone 7 through a grating 10 on the floor. A circulation duct 11 takes in the air from the operation zone 4 by a circulation fan 12 provided for the utility zone 7 through the grating 10 and circulates the air from the utility zone 7 to the ceiling chamber 3. A circulation-air temperature controller 13 is set to the circulation duct 11.

The carrying apparatus 5 uses the overhead type, in which a wafer carrier 14 storing semiconductor wafers is held by a holding portion 16 having a traveling wheel 15 and carried by a linear motor 19 on a traveling rail 18 set in a carrying route 17. Furthermore, the carrying apparatus 5 has a rolling prevention wheel 20, and a cover 21 for covering a driving portion 22 in which a traveling wheel 15, a traveling rail 18, and a linear motor 19 are arranged. The cover 20 separates the holing portion 16 of the wafer carrier 14 from the driving portion 22 of it through a small gap. An exhaust duct 23 is set to the driving portion 22. A hoisting accessory 24 secures the carrying route 17 of the overhead-type carrying apparatus 5 to the ceiling.

The storing apparatus 6 has a release portion or a door (not illustrated) for bringing in/out the wafer carrier 14, in which the upside of the opening portion or the door uses a releasing or panting plate and a side plate 24 is extended up to a height at which the air passing the fan filter unit can efficiently be obtained. Furthermore the storing apparatus 6 has a shelf board 25 using the panting plate.

The air pressure in the clean room 1 is kept higher than the pressure of outside air by a certain value by constantly detecting the air pressure in the clean room and changing the rotational speed of the draft fan of the outside-air conditioner 2 so that the air pressure is not lowered due to opening or closing of a door or exhaust gas from an apparatus in order to prevent foreign matter from entering the clean room from the outside air. Moreover, clean air (second-cleanliness air controlled to a second dust-free level) from which foreign matter such as dust is removed by the ceiling filter 8 is supplied to the operation zone 4 and the air in the operation zone 4 is drawn under the grating 10 by the circulation fan 12 provided for the utility zone 7. Therefore, the inside of the operation zone 4 is brought under a down-flow state. Furthermore, at the portion in which the fan filter unit 9 comprising a chemical filter and a draft fan is additionally set to the ceiling filter 8, foreign matter of a several-micron level is removed and clean chemical-free air (third-cleanliness air controlled to a second dust-free level) in which the concentration of chemical mist causing chemical contamination is controlled to 1 ppt to 1 f is supplied.

The fan filter unit 9 is additionally set to the ceiling of the portion where the overhead-type carrying apparatus 5 is set and only the clean chemical-free air passing through the fan filter unit 9 is supplied to the carrying route 17. The amount of the air sent out of the fan filter unit 9 is controlled so that the air pressure in the carrying route 17 is kept higher than that in other region in the operation zone 4 to prevent the air in the operation zone 4 containing chemical mist from entering the route 17. The air supplied to the carrying route 17 is spouted to the driving portion 22 from the gap of the cover 21 covering the driving portion 22 and discharged to the utility zone 7 under the grating 10 from the exhaust duct 23 together with the foreign matter produced in the driving portion 22.

Moreover, the fan filter unit 9 is additionally set to the ceiling of the portion where the storing apparatus 6 is set and thereby, only clean chemical-free air is supplied into the storing apparatus 6. A side board 34 of the storing apparatus 6 is extended in the direction of a ceiling filter portion in order to efficiently obtain the clean chemical-free air through the ceiling filter portion. The amount of the air sent out of the fan filter unit 9 is controlled so that the air pressure in the storing apparatus 6 is kept higher than that in other region in the operation zone 4 to prevent the air in the operation zone 4 containing chemical mist from entering the apparatus 6. The air supplied to the storing apparatus 6 passes through the shelf board 35 using a panting plate and then, it is immediately drawn and exhausted under the grating 10 by the circulation fan 12 provided for the utility zone 3.

It is also possible to supply the air supplied from the outside-air conditioner 2 to the utility zone 7 instead of the ceiling chamber 3 as shown by a dotted line in FIG. 1.

According to the present invention, it is possible to prevent chemical contamination of a semiconductor wafer when the wafer is carried or stored because chemical-free air from which chemical mist is removed by a chemical filter is supplied to the carrying apparatus 5 and storing apparatus 6 of the wafer. Moreover, because the present invention is constituted so that chemical-free air is supplied only to the carrying apparatus 5 and storing apparatus 6 having a semi-hermetic structure, it is possible to decrease the cost of air conditioning equipment.

Embodiment 2

Figure 2:
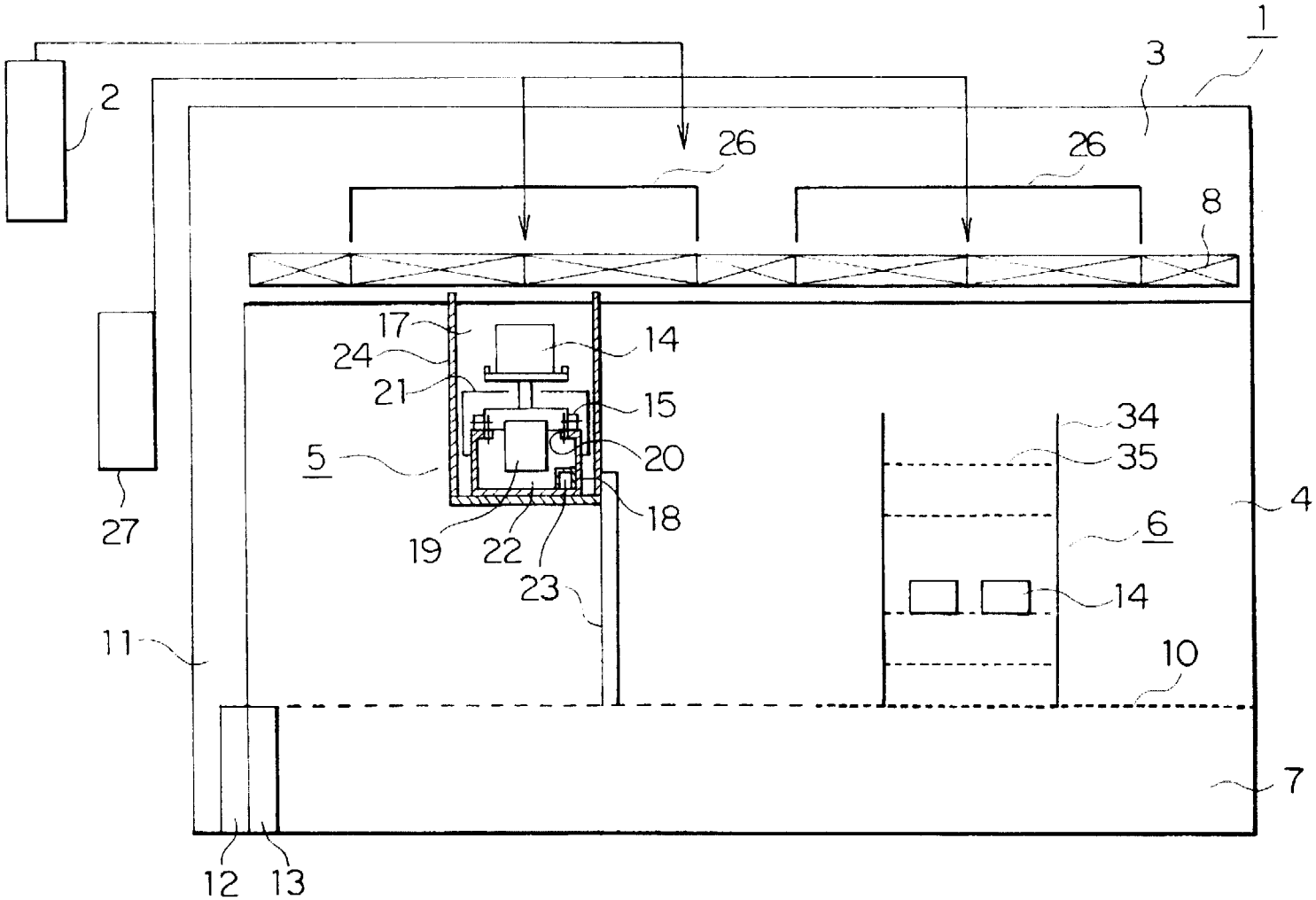
FIG. 2 is a schematic view showing the clean room of the embodiment 2 of the present invention.

In the case of the embodiment 1, a ceiling filter 8 and a fan filter unit 9 comprising a chemical filter and a draft fan are arranged above a carrying apparatus 5 and storing apparatus 6 to supply chemical-free air to the apparatuses 5 and 6. However, as shown in FIG. 2, the same advantage can also be obtained by providing an air guiding cover 26 for a ceiling chamber 3 above the portion where the carrying apparatus 5 and storing apparatus 6 are arranged, supplying chemical-free air (fourth-cleanliness chemical-free air) whose temperature and humidity are controlled and whose chemical mist concentration is controlled between 1 ppt and 1 f by a chemical-free air generator 27 into the air guiding cover 26, and supplying the air to the carrying apparatus 5 and storing apparatus 6 through a ceiling filter 8. In this case, it is necessary to set the chemical-free air pressure to be supplied to the air guiding cover 26 to a value higher than the air pressure to be supplied to a clean room. The structures of the carrying apparatus 5 and the storing apparatus 6 are the same as those of the embodiment 1.

Figure 3:
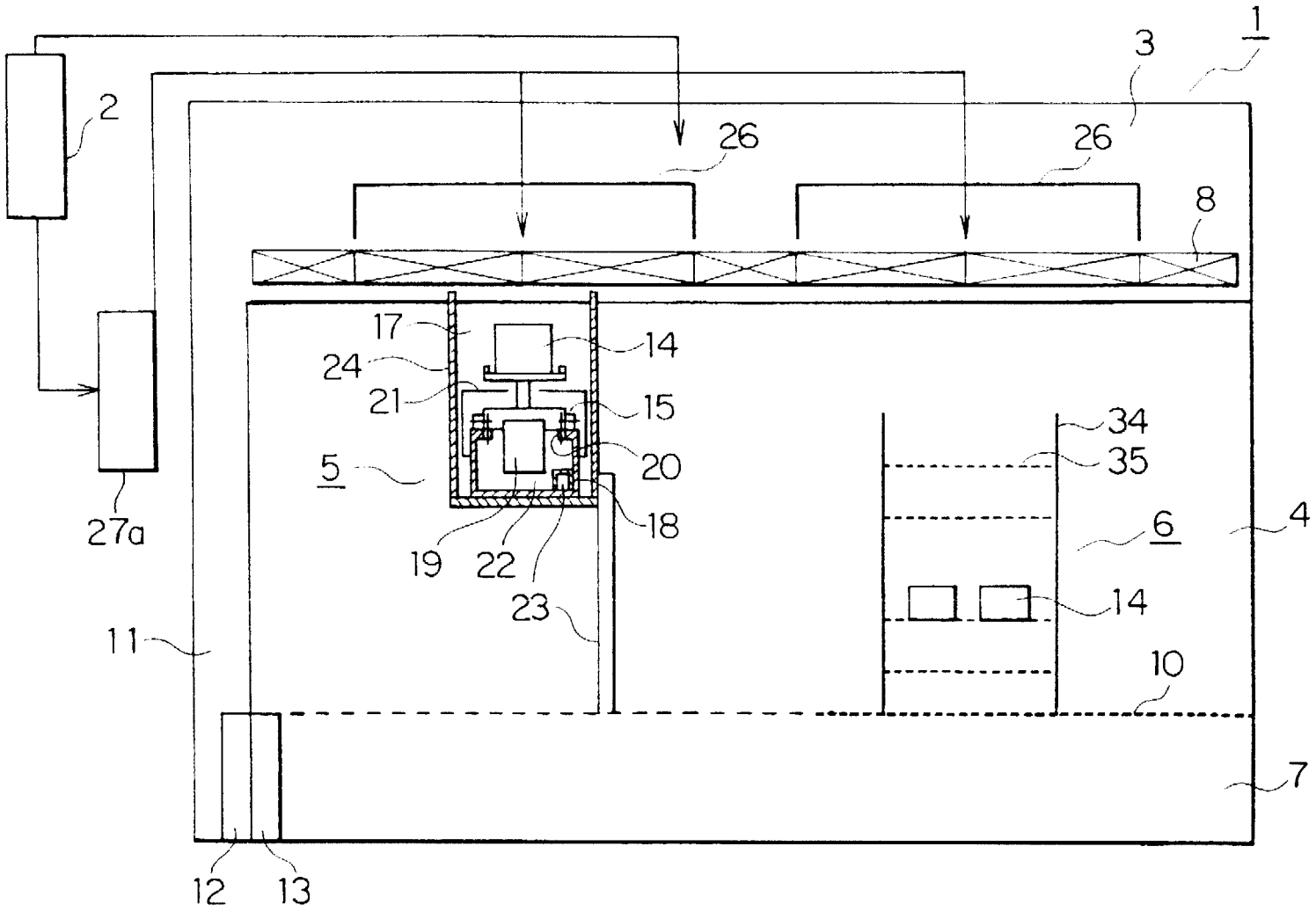
FIG. 3 is a schematic view showing the clean room of the embodiment 2 of the present invention.

Moreover, as shown in FIG. 3, it is possible to supply chemical-free air into the air guiding cover 26 by using a chemical removing apparatus 27*a* for introducing the air whose temperature and humidity are controlled from an outside-air conditioner 2 and controlling the concentration of chemical mist between 1 ppt and 1 f instead of the chemical-free air generator 27.

Embodiment 3

Figure 4:
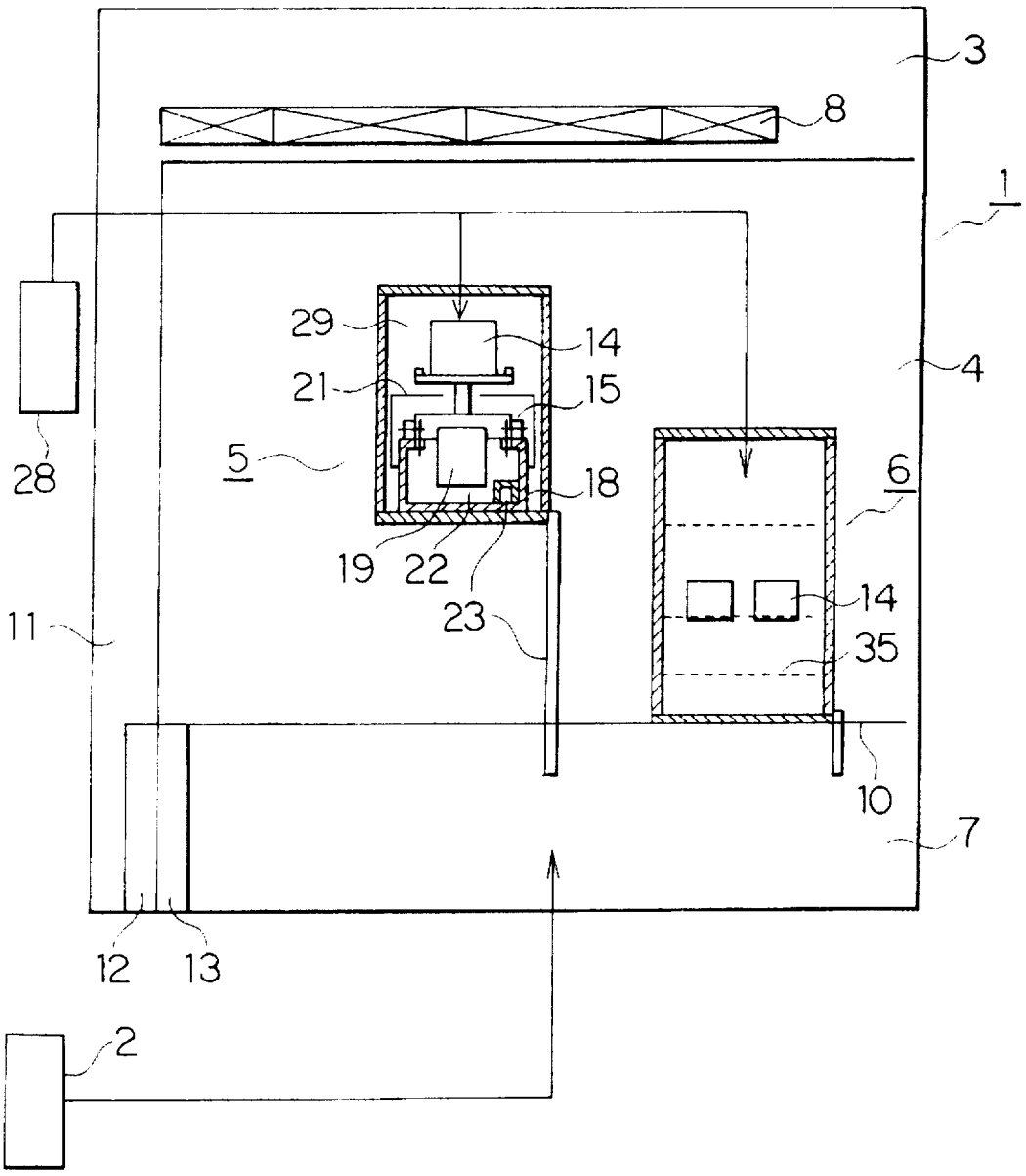
FIG. 4 is a schematic view showing the clean room of the embodiment 3 of the present invention.
Figure 5:
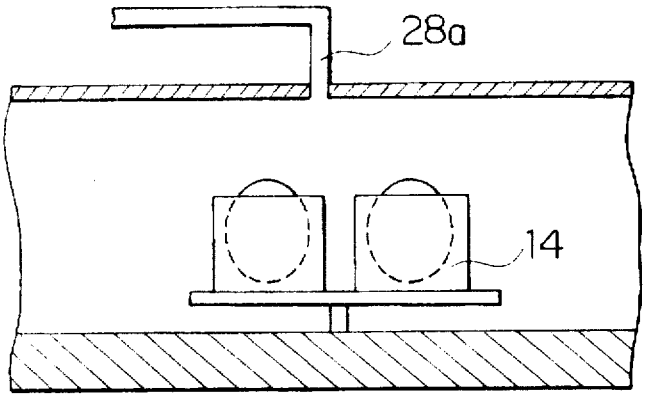
FIG. 5 is a side sectional view showing the carrying apparatus of the clean room of the embodiment 3 of the present invention.
Figure 6:
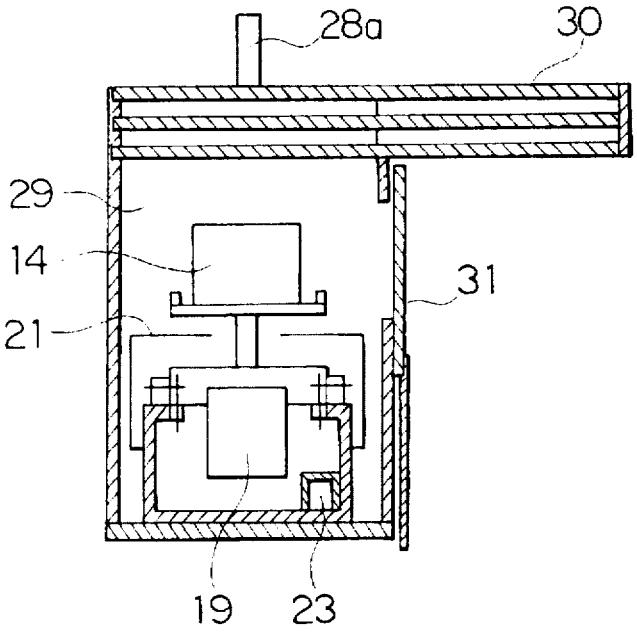
FIG. 6 is a front sectional view showing the carrying apparatus of the clean room of the embodiment 3 of the present invention.

FIG. 4 is a clean room showing embodiment 3 of the present invention, FIG. 5 is a side sectional view of a carrying apparatus set in a clean room, and FIG. 6 is a front sectional view of a carrying apparatus at a joint with fabrication equipment. In these drawings, the clean room 1 has an outside-air conditioner 2 for taking in outside air to control the temperature and humidity of the outside and thereafter supplying the air (first-cleanliness air controlled to a first dust-free level) to the clean room 1. The clean room 1 comprises a ceiling chamber 3, an operation zone 4 in which fabrication equipment, a carrying apparatus 5 having a carrying route 29 of a hermetic structure, and storing apparatus 6 are arranged and operations are performed, and a utility zone 7 in which motive-power equipment and environment maintenance equipment are arranged and to which air is supplied from the outside-air conditioner 2. A ceiling filter 8 such as an HEPA filter or a ULPA filter for removing foreign matter such as dust of a several-micron level from the air in the ceiling chamber 3 is set between the ceiling chamber 3 and the operation zone 4. A ceiling filter 8 removes dust of a several-micron level from the air in the ceiling chamber 3 and supplies the air to the operation zone 4. The operation zone 4 contacts the utility zone 7 through a grating 10 on the floor. A circulation duct 11 takes in the air from the operation zone 4 by a circulation fan 12 provided for the utility zone 7 through the grating 10 and circulates the air from the utility zone 7 to the ceiling chamber 3. A circulation-air temperature controller 13 is set to the circulation duct 11. A chemical-free dry air generator 28 removes foreign matter of a several-micron level and supplies the chemical-free dry air whose chemical mist concentration is controlled between 1 ppt and 1 f and whose moisture concentration is controlled to 1 ppb or less to the carrying apparatus 5 and the storing apparatus 6. A visor 30 is formed at the joint with fabrication equipment by protruding it from a carrying route 29, and has a chemical-free dry air discharge portion. A gate shutter 31 of the carrying route 29 is provided for the joint with fabrication equipment.

Because the internal structures of the carrying apparatus 5 and storing apparatus 6 are the same as those shown in FIG. 1, their description is omitted.

The air pressure in the clean room 1 is controlled so as to be higher than outside air pressure by a certain value by constantly detecting the air pressure in the clean room and changing the rotational speed of the draft fan of the outside-air conditioner 2 so that the air pressure is not lowered due to opening or closing of a door or exhaust gas from equipment in order to prevent foreign matter from entering the clean room from outside air. Moreover, because the air exhausted from the carrying apparatus 5 and storing apparatus 6 to the utility zone 7 is dry air, the air supplied from the outside-air conditioner 2 is introduced into the utility zone and the humidity of the air in the utility zone 7 is controlled by controlling the humidity of the air supplied from the outside-air conditioner 2 to circulate the air in the ceiling chamber 3 through the circulation duct 11. Furthermore, clean air from which foreign matter such as dust is removed by the ceiling filter 8 is supplied to the operation zone 4 and the air in the operation zone 4 is drawn and exhausted under the grating 10 by the circulation fan provided for the utility zone 7. Therefore, the inside of the operation zone 4 is brought under a down-flow state.

The chemical-free dry air sent from the chemical-free dry air generator 28 through a supply pipe 28*a* is supplied into the carrying route 29 having a tunnel structure, spouted to a driving portion 22 from the gap of a cover 21 covering the driving portion 22, and immediately drawn and exhausted to the utility zone 7 under the grating 10 from an exhaust duct 23 together with the foreign matter produced in the driving portion 22. At the joint with fabrication equipment, the gate shutter 31 automatically opens by detecting a wafer carrier 14 in accordance with a predetermined step and the chemical-free dry air supplied from the chemical-free dry air generator 28 is spouted from the visor 30 to prevent the semiconductor wafers stored in the wafer carrier from being chemically contaminated at the joint with fabrication equipment.

The chemical-free dry air sent from the chemical-free dry air generator 28 through the supply pipe 28*a* is supplied to the storing apparatus 6 having a hermetic structure and immediately drawn and exhausted to the utility zone 7 under the grating 10 from the exhaust duct 23 through the holes of a shelf board 25 using a panting plate.

This embodiment can prevent a semiconductor wafer from being chemically contaminated when the wafer is carried or stored and an oxide film from being naturally formed on the wafer due to moisture because chemical-free dry air whose chemical mist and moisture are controlled to a predetermined level or lower is supplied to the carrying apparatus 5 and storing apparatus 6 of the semiconductor wafer. Moreover, because this embodiment is constituted so that the chemical-free dry air is supplied only to the carrying apparatus 5 and storing apparatus 6 both of which have a hermetic structure, it is possible to decrease the cost of air conditioning equipment.

Embodiment 4

Figure 7:
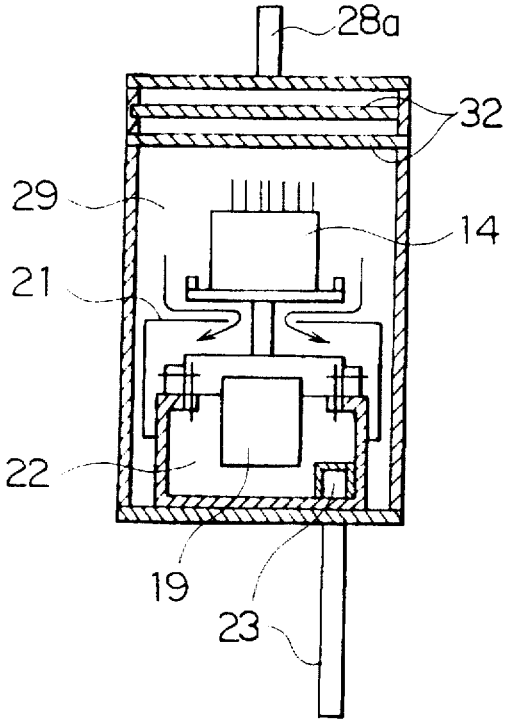
FIG. 7 is a front sectional view showing the carrying apparatus of the clean room of the embodiment 4 of the present invention.
Figure 8:
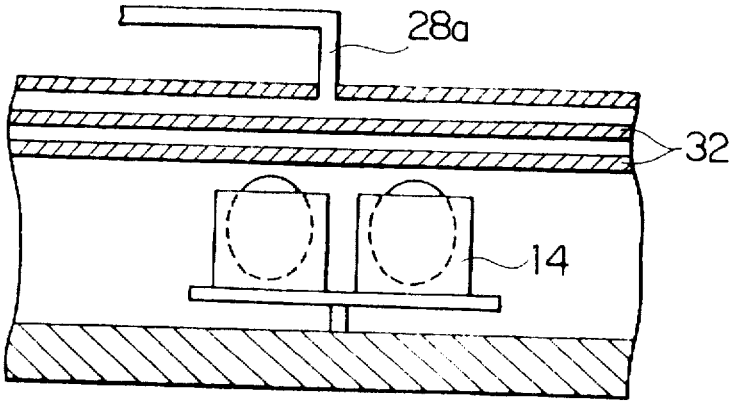
FIG. 8 is a side sectional view showing the carrying apparatus of the clean room of the embodiment 4 of the present invention.
Figure 9:
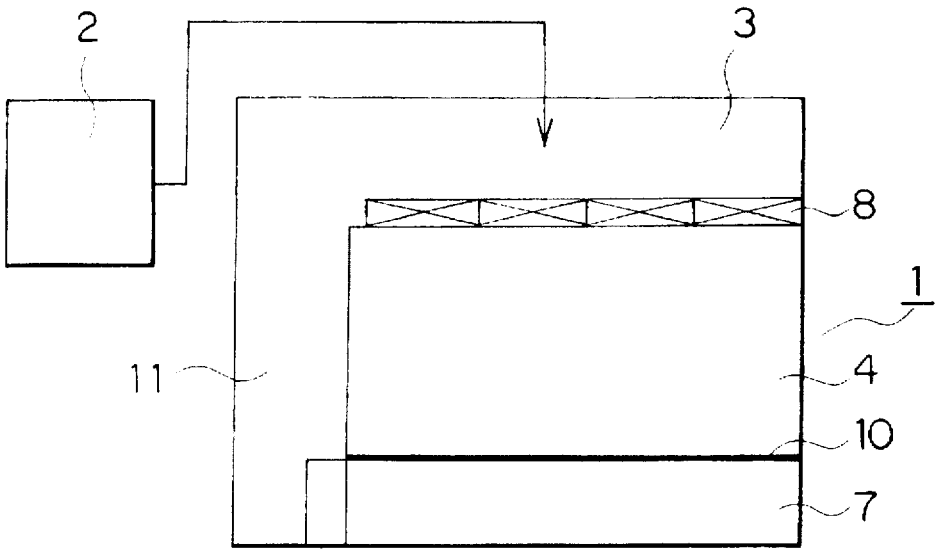
FIG. 9 is a schematic view showing this type of the conventional clean room.
Figure 10:
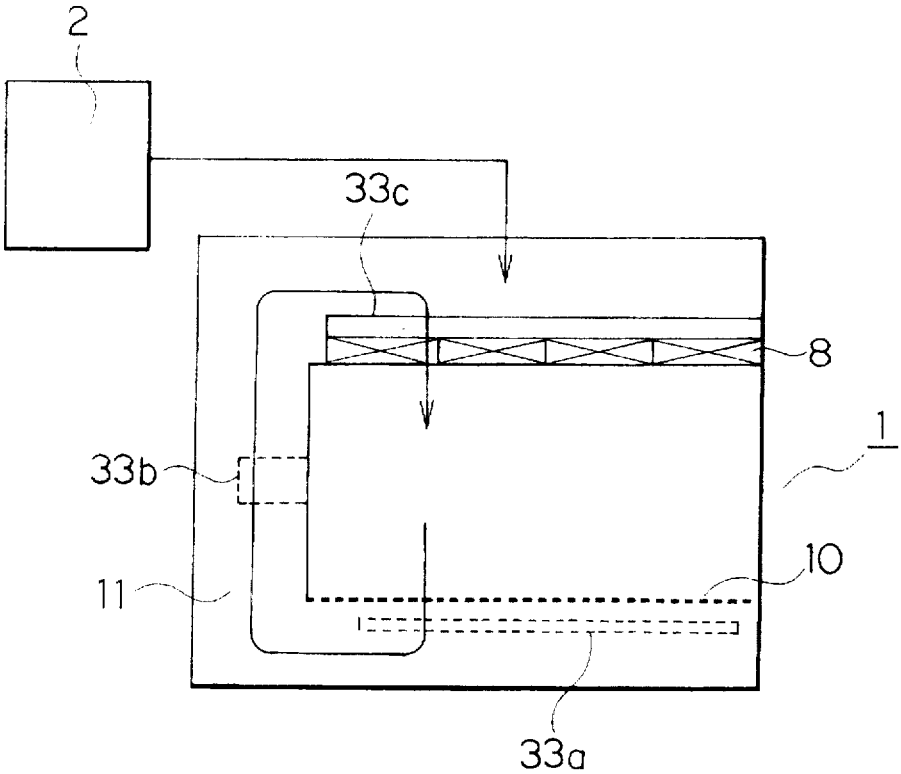
FIG. 10 is a schematic view showing another type of the conventional clean room.

FIGS. 7 and 8 are a front sectional view and a side sectional view showing the carrying apparatus of embodiment 4 of the present invention. In FIGS. 7 and 8, A pair of current plates 32 having a plurality of small-diameter holes is arranged in parallel at a predetermined interval on a carrying route 29. Because other structures are the same as those of the embodiment 3, their description is omitted.

This embodiment can control the direction of the flow of chemical-free dry air and supply the chemical-free dry air uniformly into the carrying route 29 by supplying the chemical-free dry air supplied through a chemical-free dry air supply pipe 28*a* into the carrying route 29 through small-diameter holes formed on the current plates 32.

As described above, according to the present invention, it is possible to improve the quality and yield of semiconductor devices by preventing chemical contamination of a semiconductor wafer when the wafer is carried or stored in the semiconductor device fabrication process and moreover decrease the cost of air conditioning equipment because air conditioning can locally be performed according to necessity.

What is claimed is:

1. A clean room comprising:

an outside-air conditioner taking in outside air and controlling the temperature and humidity of said outside air and supplying first-cleanliness air controlled to a first dust-free level to said clean room so that the inside of said clean room is kept at a pressure higher than the outside-air pressure;

a ceiling chamber to which said first-cleanliness air is supplied from said outside-air conditioner;

a ceiling filter for cleaning said first-cleanliness air in said ceiling chamber up to second-cleanliness air at a second dust-free level;

a fan filter unit set to the upstream side of said ceiling filter to remove a predetermined chemical substance from air up to a predetermined content level;

an operation zone to which the air controlled to second cleanliness by said ceiling filter is supplied and in which the chemical-free air controlled to the third cleanliness at a second dust-free level by said fan filter unit is supplied to a predetermined region;

a utility zone which is located under the grating floor in said operation zone and in which motive-power supply equipment and environment maintenance equipment are arranged; and an air circulation system for controlling the temperature of the air to be exhausted from said operation zone to said utility zone and circulating air from said utility zone to said ceiling chamber through a duct.

2. A clean room comprising:

an outside-air conditioner taking in outside air and controlling the temperature and humidity of said outside air and supplying first-cleanliness air controlled to a first dust-free level to said clean room so that the inside of said clean room is kept at a pressure higher than the outside-air pressure;

a chemical-free generator taking in outside air and controlling the temperature and humidity of said outside air and generating the fourth-cleanliness chemical-free air which is controlled to a first dust-free level and from which a predetermined chemical substance is removed up to a predetermined content level;

a ceiling chamber to which said first-cleanliness air is supplied by said outside-air conditioner;

an air guiding cover which is set in a predetermined region in said ceiling chamber and to which the fourth-cleanliness chemical-free air is supplied from said chemical-free air generator;

a first ceiling filter for cleaning first-cleanliness air in said ceiling chamber up to second-cleanliness air at a second dust-free level and a second ceiling filter for cleaning said fourth-cleanliness chemical-free air to the third-cleanliness air at the third dust-free level;

an operation zone to which the air controlled to second cleanliness by said first ceiling filter is supplied and in which the chemical-free air supplied into said air guiding cover is cleaned up to the third-cleanliness chemical-free air by said second ceiling filter and supplied to a predetermined region;

a utility zone which is located under the grating floor in said operation zone and in which motive-power supply equipment and environment maintenance equipment are arranged; and an air circulation system for controlling the temperature of the air to be exhausted from said operation zone to said utility zone and circulating air from said utility zone to said ceiling chamber through a duct.

3. A clean room according to claim 2, wherein said chemical-free air generator is a chemical removing apparatus to which first-cleanliness air is supplied from an outside-air conditioner to remove a predetermined chemical substance from said first-cleanliness air up to a predetermined content level.

4. A clean room according to claim 1, wherein said first-cleanliness air is supplied to said utility zone from said outside-air conditioner.

5. A clean room according to claim 1, wherein the air pressure in a predetermined region in said operation zone is controlled so as to be kept higher than the air pressure in other region in said operation zone.

6. A clean room according to claim 1, wherein a predetermined region in said operation zone serves as a portion in which a carrying apparatus and a storing apparatus respectively having an opening through which the introduced said third-cleanliness chemical-free air is exhausted to the outside are set.

7. A clean room according to claim 6, wherein said carrying apparatus is an overhead-type carrying apparatus hung from said ceiling in said operation zone; provided with a holding portion for holding a carried object, a driving portion in which a drive and the like are arranged, a cover for separating said holding portion from said driving portion through a gap, and an exhaust duct provided for said driving portion; and constituted so as to exhaust the air supplied through said ceiling filter portion to said utility zone from the exhaust duct of said driving portion through the gap of said cover from said holding portion.

8. A clean room according to claim 6, wherein said storing apparatus is an apparatus having a semi-hermetic structure set on the grating in said operation zone; provided with a side board extended in the direction of said ceiling filter portion in order to efficiently obtain the air supplied through said ceiling filter portion and a shelf board having a plurality of small-diameter holes; and constituted so as to exhaust the air supplied through said ceiling filter portion under said grating through the holes of said shelf board.

9. A clean room comprising:

an outside-air conditioner taking in outside air and controlling the temperature and humidity of said outside air and supplying first-cleanliness air controlled to a first dust-free level to said clean room so that the inside of said clean room is kept at a pressure higher than the outside-air pressure;

a chemical-free dry air generator taking in outside air, and generating the fifth-cleanliness chemical-free dry air which is controlled the temperature and humidity and controlled to a second dust-free level and obtained by removing a predetermined chemical substance and moisture from air up to predetermined content levels;

an operation zone in which a carrying apparatus and a storing apparatus respectively having a hermetic structure to which chemical-free dry air is supplied from said chemical-free dry air generator are arranged;

a utility zone which is located under the grating floor in said operation zone, in which motive-power supply equipment and environment maintenance equipment are arranged, and to which air is supplied from said operation zone and exhaust ports of said carrying apparatus and storing apparatus and moreover, air is supplied from said outside-air conditioner;

an air circulation system for controlling the temperature of the air in said utility zone and circulating the air to a ceiling chamber through a duct; and a ceiling filter set in said ceiling chamber to clean introduced first-cleanliness air up to second-cleanliness air and supply the second-cleanliness air to said operation zone.

10. A clean room according to claim 9, wherein said carrying apparatus is provided with a carrying route having a hermetic structure, a supply portion of dry air supplied from said chemical-free dry air generator provided for the ceiling portion of said carrying route, a holding portion provided for the top in said carrying route to hold a carried object, a driving portion which is provided for the bottom in said carrying route and in which a drive is arranged, a cover for separating said holding portion from said driving portion with a gap, and an exhaust duct provided for said driving portion and constituted so that the dry air supplied to the ceiling portion of said carrying route through a pipe is exhausted from the exhaust duct of said driving portion to said utility zone through the gap of said cover.

11. A clean room according to claim 10, wherein said carrying route is provided with current plates having a plurality of small-diameter holes and formed in parallel at a predetermined interval in order to uniformly supply the dry air supplied to a ceiling portion into said carrying route.

12. A clean room according to claim 10, wherein said carrying apparatus is provided with a carried-object detector, an opening to which an openable shutter is set, and a visor portion formed so as to protrude from the wall of a carrying route onto said opening having a portion for supplying the dry air supplied from said chemical-free dry air generator.

13. A clean room according to claim 9, wherein said storing apparatus is provided with a reservoir having a hermetic structure, a portion for supplying the dry air supplied from said chemical-free dry air generator provided for the ceiling portion of said reservoir, a shelf board having a plurality of small-diameter holes, and an exhaust duct provided for the bottom of said reservoir and constituted so that the dry air supplied to said ceiling portion of said reservoir through a pipe is exhausted to said utility zone from said exhaust duct through the holes of said shelf board.

14. A clean room according to claim 1, wherein the predetermined content levels of predetermined chemical substances of said third-cleanliness chemical-free air and said fourth-cleanliness chemical free air are kept in a range between 1 ppt and 1 f.

15. A clean room according to claim 9, wherein the predetermined content level of a predetermined chemical substance of said fifth-cleanliness chemical-free dry air is kept in a range between 1 ppt and 1 f and that of moisture of the dry air is kept at 1 ppb or less.

* * * * *